United States Patent [19]

Kawaguchi et al.

[11] Patent Number: 4,541,347

[45] Date of Patent: Sep. 17, 1985

[54] AUTOMATIC WORK GUIDING APPARATUS FOR SEWING MACHINES

[75] Inventors: Hideo Kawaguchi; Etuzo Nomura, both of Nagoya, Japan

[73] Assignee: Brother Kogyo Kabushiki Kaisha, Aichi, Japan

[21] Appl. No.: 444,071

[22] Filed: Nov. 24, 1982

[30] Foreign Application Priority Data

Dec. 16, 1981 [JP] Japan ..... 56-203230

[51] Int. Cl.[4] ..... D05B 19/00

[52] U.S. Cl. ..... 112/121.11; 112/153; 112/306; 112/318

[58] Field of Search ..... 112/306, 305, 303, 312, 112/313, 314, 318, 319, 320, 153, 235, 121.26, 121.11, 272

[56] References Cited

U.S. PATENT DOCUMENTS

| | | | |
|---|---|---|---|
| 4,074,640 | 2/1978 | Chano et al. | 112/153 X |
| 4,126,097 | 11/1978 | Willenbacher | 112/153 |
| 4,214,540 | 7/1980 | Cook | 112/235 |

*Primary Examiner*—Peter Nerbun

*Attorney, Agent, or Firm*—Browdy and Neimark

[57] ABSTRACT

A fabric-guiding apparatus for guiding a fabric layer across a line of fabric feed along a side edge of the fabric layer, including a detector sensing the side edge of the fabric layer and generating a detection signal, a guiding wheel rotatable about an axis parallel to the line of fabric feed, a pressure exerting device for exerting a contact pressure urging the guiding wheel into engagement with the fabric layer, and a first drive motor to rotate the guiding wheel for laterally moving the side edge of the layer into position prior to a sewing cycle. The pressure exerting device comprises a pressure adjusting mechanism to adjust the contact pressure, a second drive motor to actuate the adjusting mechanism, a drive circuit responsive to command signals, a memory storing command data relating to the command signals, and a control circuit. The control circuit supplies to the drive circuit a certain number of the command signals for changing the contact pressure in predetermined increments prior to the sewing cycle, updating the memory upon every supply of the command signals to the drive circuit, outputs a rotation signal to operate the first drive motor when the command signals are supplied to the drive circuit, and checks according to the detection signal if the fabric layer has been moved into position by the guiding wheel, whereby an optimum level of the contact pressure is established between the guiding wheel and the surface of the fabric layer before the sewing cycle is initiated.

10 Claims, 11 Drawing Figures

FIG. 3
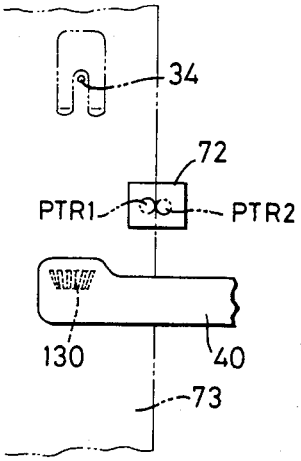
FIG. 5
REG40
| B7 | B6 | B5 | B4 | B3 | B2 | B1 | B0 |
|---|---|---|---|---|---|---|---|
| SS | SC | SM | | SD4 | SD3 | SD2 | SD1 |
FIG. 6
REG60
| B7 | B6 | B5 | B4 | B3 | B2 | B1 | B0 |
|---|---|---|---|---|---|---|---|
| DP2 | DP1 | DS2 | DS1 | UP2 | UP1 | US2 | US1 |
FIG. 7
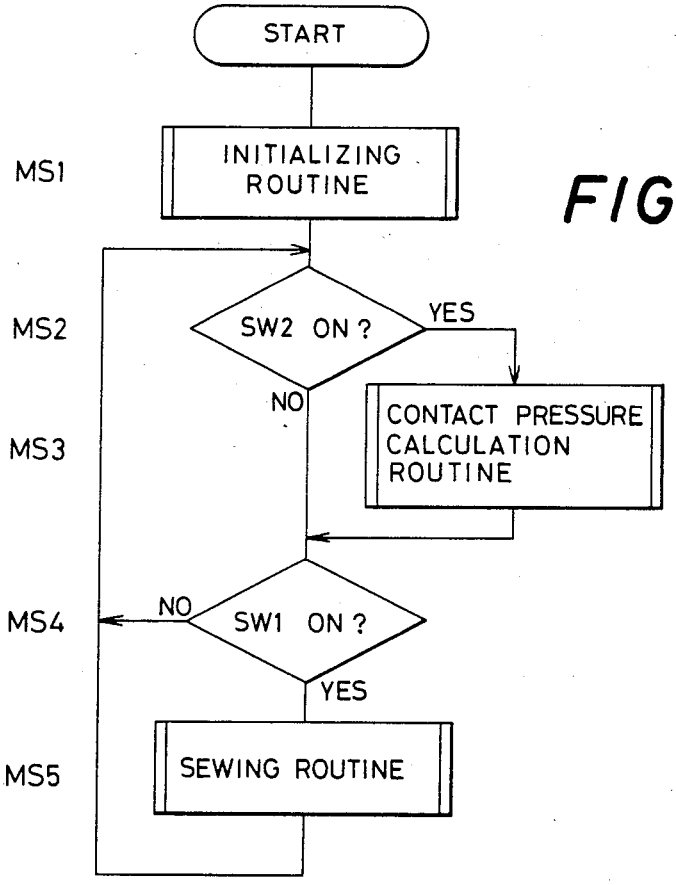

AUTOMATIC WORK GUIDING APPARATUS FOR SEWING MACHINES

BACKGROUND OF THE INVENTION

The present invention relates generally to an automatic work guiding apparatus particularly for a sewing machine, and more particularly to such automatic work guiding apparatus wherein a rotary wheel engaging a work fabric to guide the same relative to a reference line during a sewing cycle is automatically adjusted in its pressure of guiding contact with the work fabric to an optimum level depending upon specific material, thickness, stiffness and other properties of the work fabric.

In the art of forming successive stitches along a predetermined seamline which is inwardly offset from the side edge contour of a workpiece such as a sheet or layer of fabric or other materials, there has been known an automatic workpiece guiding apparatus which comprises: a detecting device disposed ahead or in front of a stitch forming position or needle position in the direction of workpiece feeding and sensing a lateral deviation or displacement of the side edge of the workpiece from a predetermined reference position; a rotary wheel supported engageably with the workpiece and rotatably about an axis substantially parallel to the workpiece feeding direction; first drive means for rotating the rotary wheel to move the workpiece in the direction perpendicular to the workpiece feeding direction according to detection signals from the detecting device; and a contact pressure adjusting mechanism for adjusting as required a pressure of contact or engagement of the rotary wheel with the workpiece.

In such automatic workpiece guiding apparatus known in the art, however, it has been required to conduct, prior to a production sewing, a trial sewing operation each time the workpiece is changed from one kind to another. This trial sewing is performed with a contact pressure of the rotary wheel which is predetermined at a level which is supposed to be suitable to the new workpiece. Therefore, the trial sewing has to be repeated several times until an optimum contact pressure of the wheel has been established. Thus, the conventional workpiece guiding apparatus requires a long time and a high standard of skill of the operator for such trial sewing. For assuring fine stitching results, on the other hand, it is of prime importance to set up an optimum level of contact pressure of the wheel against the workpiece, in view of the fact that a lower contact pressure thereof than required will reduce the ability of the wheel to guide the workpiece and consequently cause a failure in forming the stitches at correct positions along the side edge of the workpiece, while a higher contact pressure thereof than required will cause sewing defects such as offsetting of some stitches away from the seamline and irregularity in pitch between the stitches due to strain or deformation of the workpiece under the excessive.

SUMMARY OF THE INVENTION

It is accordingly an object of the present invention to provide an automatic work or fabric guiding apparatus for a sewing machine, which is capable of automatically establishing an optimum pressure of contact of a rotary guiding wheel with a workpiece, depending upon specific material, thickness and other properties of the workpiece and without having to conduct a trial sewing for establishment of the optimum pressure prior to a production run of the machine.

According to the invention, there is provided a fabric-guiding apparatus for guiding a fabric layer in a direction intersecting a line of fabric feed in a sewing machine having a seam forming mechanism and a fabric feeding mechanism for sewing along a side edge of the fabric layer, including (a) a detector member disposed ahead of the seam forming mechanism in a direction of the line of fabric feed, including a detector element sensing the side edge of the fabric layer and generating a detection signal indicative of the sensing of the side edge, (b) a guiding wheel rotatable about an axis parallel to the line of fabric feed and engageable with the surface of the fabric layer, (c) pressure exerting means for exerting a contact pressure urging the guiding wheel into engagement with the surface of the fabric layer, and (d) first drive means, operative in response to the detection signal from the detector member, for rotating the guiding wheel selectively in forward and reverse directions for moving the side edge of the fabric layer on the detector element laterally with respect to the line of fabric feed, characterized in that the pressure exerting means comprises:

a pressure adjusting mechanism to adjust the contact pressure;

second drive means to actuate the pressure adjusting mechanism;

a drive circuit connected to the second drive means and operative in response to command signals;

a memory for storing command data relating to the command signals and representative of the contact pressure; and control means for automatically establishing an optimum level of the contact pressure, the control means supplying to the drive circuit a predetermined number of the command signals for changing the contact pressure in steps of a predetermined amount prior to a normal operation of the fabric-guiding apparatus occurring during formation of a seam by the seam forming and fabric feed mechanisms, updating the command data each time the predetermined number of the command signals have been supplied to the drive circuit outputting a rotation signal to operate the first drive means for laterally moving the fabric layer when each of the command signals is supplied to the drive circuit, and checking according to the detection signal whether or not the fabric layer has been moved into position by the guiding wheel, whereby the command data stored in the memory when the fabric layer has been moved into position represent data relating to the optimum level of contact pressure.

According to the automatic work guiding apparatus constructed as described above, a pressure of contact or engagement of the rotary wheel with the workpiece is changed in steps of a predetermined amount prior to normal operation of the apparatus during a sewing cycle, and the rotary wheel is driven upon each change of its contact pressure so as to feed the workpiece in a lateral direction across the work feeding direction. The stepping change of the contact pressure of the wheel is continued until the side edge of the workpiece has been located at the predetermined reference position, and the level of pressure established at the end of this initial positioning of the workpiece is used to determine an optimum contact pressure of the wheel which is applied to the workpiece while it is sewn under guiding control of the present apparatus. Thus, the guiding apparatus of the invention permits automatic setup of an optimum contact pressure of the rotary guiding wheel without the need of conventional trial sewing, and consequently saves non-productive time for such trial sewing operations, thereby assuring efficient production of high-quality garments or other products without requiring a high standard of operator's skill.

BRIEF DESCRIPTION OF THE DRAWINGS

The above and other objects, features and advantages of the present invention will become more apparent from reading the following description of the preferred embodiment taken in connection with the accompanying drawings in which:

FIG. 3 is a schematic illustration of a part of the arrangement of FIG. 1;

FIGS. 5 and 6 are views showing registers provided in a RAM of FIG. 4;

FIG. 7 is a flow chart showing a main program executed in the embodiment of FIG. 1.

DETAILED DESCRIPTION OF THE PREFERRED EMBODIMENT

The present invention will be described in detail with reference to the accompanying drawings which illustrate a preferred form of an automatic work guiding apparatus constructed according to the present invention.

Figure 1:
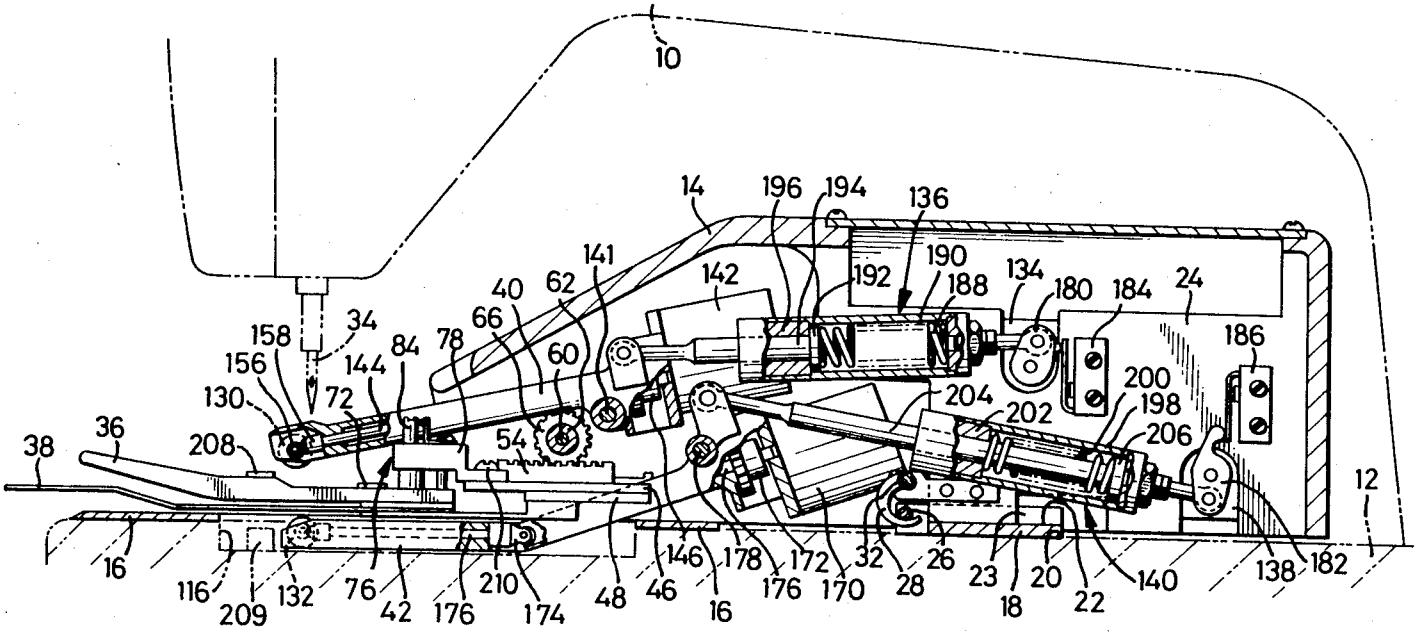
FIGS. 1 and 2 are elevational and plan views of a mechanical arrangement of one embodiment of the invention, respectively.
Figure 2:
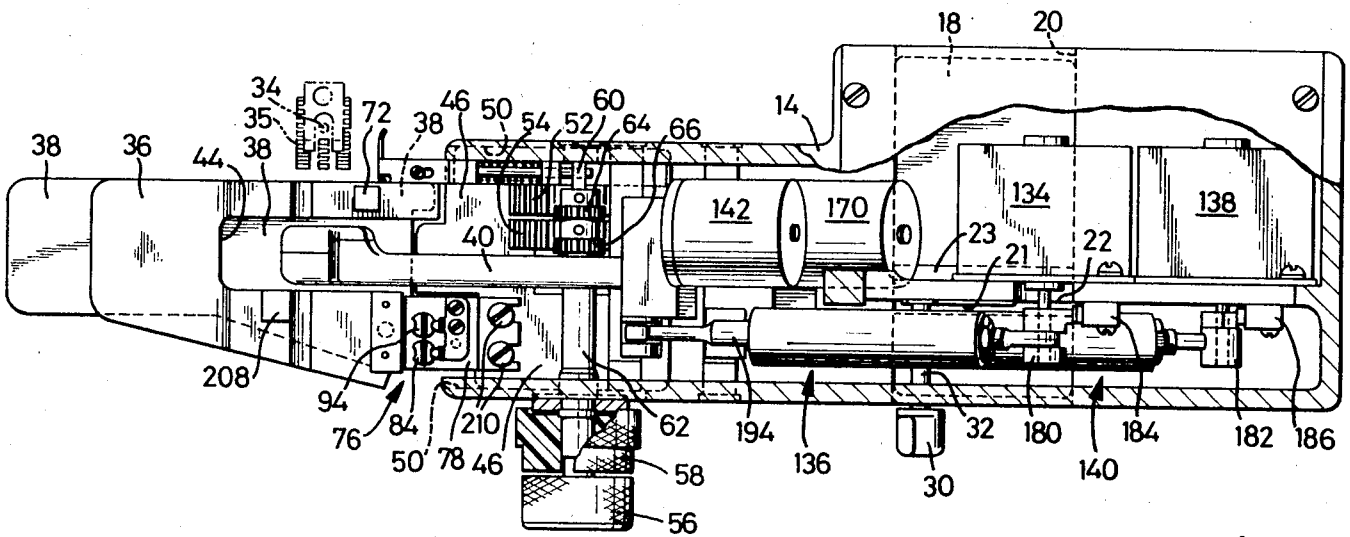

Referring first to FIGS. 1 and 2, there is shown a bed 12 on which a machine arm 10 is mounted. To the bed 12 are secured a spacer plate 16 and a mounting block 18 on which is mounted a generally box-shaped housing 14 extending as a whole longitudinally of the machine arm 10. Two longitudinal projections 21 and 23 are formed on the mounting block 18 in parallel to the length of the machine arm 10, so that a groove 22 is defined by the projections 21, 23. The bottom wall of the housing 14 has a recess 20 which is formed in a direction across the length of the housing 14. The housing 14 is positioned in place with respect to the bed 12 such that the recess 20 engages the mounting block 18 while the groove 22 engages the lower end of an intermediate wall 24 which extends vertically within the housing 14. The mounting block 18 has, at its groove 22, a horizontally extending pin 26 fixed thereinto, and the housing 14 is provided, at its lower portion, with a rotary shaft 32 which has, at its opposite ends, a hook 28 engageable with the pin 26, and a fixing lever 30 which is manually pivoted to rotate the rotary shaft 32 and thereby pivot the hook 28 so that it engages the pin 26. Thus, the housing 14 is secured to the bed 12.

The housing 14 has an end portion which is open to an area of the bed 12 which is upstream of a stitch forming point, i.e., lowered position of a needle 34, as viewed in the direction in which a work fabric is fed under feeding actions of a feed dog 35. An upper plate 36, a separator plate 38, an upper arm 40 and a lower arm 42 which are fixed at their respective portions within the housing 14, are projected out of the housing 14 through its open end portion.

The separator plate 38 is a thin metal sheet for separating two layers of work fabrics one from the other in a vertical direction. The upper plate 36 is a planar member of synthetic resin which is vertically spaced a predetermined distance from the surface of the separator plate 38 for guiding the work fabric therebetween. The upper plate 36 has an opening 44 which allows the free end of the upper arm 40 to engage the work fabric on the separator plate 38. The separator and upper plates 38 and 36 are both supported at one end thereof by an upper sliding plate 46 disposed within the housing 14.

A lower sliding plate 48 is also disposed within the housing 14. The upper and lower sliding plates 46 and 48 which are held in contact with each other, are supported in a pair of parallel slide grooves 50 which are formed in the opposite inner surfaces of the walls of the open end portion of the housing 14 along the length thereof, whereby the plates 46 and 48 are slidable in the horizontal plane along the pair of grooves 50. The upper and lower sliding plates 46 and 48 are provided, on their upper surfaces, with racks 52 and 54 fixed thereto respectively. The racks 52 and 54 are adapted to mate respective pinions 64 and 66 which are both connected to an inner rotary shaft 60 and an outer rotary tubing 62 fitting on and concentric with the inner rotary shaft 60. The inner rotary shaft 60 and the outer rotary tubing 62 are provided, at one end thereof remote from the pinions 64, 66, with an upper slide knob 56 and a lower slide knob 58, respectively. To prevent free rotation of those knobs 56 and 58, suitable friction members (not shown) are interposed between the knob 58 and the adjacent wall surface of the housing 14, and between the two knobs 56 and 58.

On the upper plate 36, there is secured a photoelectric unit 72 such that it faces the upper surface of the separator plate 38 in order to sense the position of the upper work fabric separated onto the separator plate 38, more particularly, to detect a deviation of the side edge of the work fabric from the predetermined reference position. By manipulating the upper slide knob 56, therefore, the position at which the side edge of the upper work fabric between the separator and upper plates 38 and 36 is detected, is adjustable in a direction normal to the work feeding direction. The photoelectric unit 72 which is located in front of the lowered needle position as shown in FIG. 2, includes two pairs of light emitting diodes and phototransistors; LED1 and PTR1, and LED2 and PTR2. The phototransistors PTR1 and PTR2 are positioned as illustrated in FIG. 3 so that when the side edge of the work fabric 73 is placed at the reference position a light reflected by the separator plate 38 is blocked or obstructed by the work fabric before it is received by the phototransistor PTR1 while a light similarly reflected, on the other hand, is not blocked and therefore received by the phototransistor PTR2. In other words, the center point between the phototransistors PTR1 and PTR2 as viewed in the horizontal plane is selected as the reference position with respect to which the side edge of the work fabric 73 is checked for its position. In this specific embodiment, the phototransistor PTR1 is located on the inner side of the work fabric and the PTR2 on the outer side thereof.

On the lower sliding plate 48, there is secured another photoelectric unit (not shown), similar to the photoelectric unit 72, which includes two pairs of light emitting diodes and phototransistors; LED3 and PTR3, and LED4 and PTR4. This photoelectric unit serves to detect a deviation of the side edge of the lower work fabric from the predetermined reference position.

Referring back to FIGS. 1 and 2, there is shown a clearance adjusting unit 76 which connects the separator and upper plates 38 and 36 so that they are supported by the upper sliding plate 46. The adjusting unit 76 has an upper clearance adjusting knob 94 and a lower clearance adjusting knob 84 which are used to adjust a clearance between the upper plate 36 and the separator plate 38, and a clearance between the separator plate 38 and the spacer plate 16, respectively, depending upon a thickness of the upper and lower work fabrics sandwiched therebetween.

The free end portion of the lower arm 42 is accommodated within a cavity 116 defined by a recess formed in the upper plate 16 on the bed 12 and by a recess formed in the bed 12.

The housing 14 incorporates upper and lower work guiding assemblies which are capable of engaging the workpiece and moving it in a direction substantially perpendicular to the work feeding direction while permitting the workpiece to be fed in its feeding direction. The upper work guiding assembly comprises the upper arm 40 having at its free end a rotary wheel 130 which rotates about an axis substantially parallel to the work feeding direction, a stepping motor 134 to pivot in steps the upper arm 40, and a resilient link 136 which resiliently transmits a driving force of the stepping motor 134 to the upper arm 40. Likewise, the lower work guiding assembly comprises the lower arm 42 having at its free end a rotary wheel 132, a stepping motor 138 designed as drive means to pivot in steps the lower arm 42, and a resilient link 140 which resiliently transmits a driving force of the stepping motor 138 to the lower arm 42.

The upper arm 40 is supported by a pin 141 pivotally in the housing 14 in a plane perpendicular to the work feeding direction so that the rotary wheel 130 at its end presses the work fabric against the surface of the separator plate 38.

To the supported end of the upper arm 40 is connected a servo motor 142 designed as drive means to rotate the rotary wheel 130 via a drive shaft 144 extending through the arm 40, a speed reduction gear 146 fixed to one end of the shaft 144, and a mating gear (not shown) of small diameter connected to the servo motor 142. The rotary wheel 130 is supported at the free end of the upper arm 40 such that the peripheral teeth is partly exposed downwardly toward the upper plate 36. The wheel 130 has a bevel gear 156 at one end of its axis and the drive shaft 144 has at the other end thereof a bevel gear 158 which mates the bevel gear 156, whereby the rotary wheel 130 is operatively connected to the servo motor 142.

To the supported end of the lower arm 42 is connected a servo motor 170 designed as drive means to rotate the rotary wheel 132 via a drive shaft 176 extending through the arm 42 and having a universal joint 174 at its middle portion, a speed reduction gear 172 fixed to one end of the shaft 174, and a mating gear (not shown) of small diameter connecting to the servo motor 170. The lower arm 42 is bent at its middle portion so that its portion on the free end side is disposed in the cavity 116 substantially horizontally to guide the lower work fabric positioned below the separator plate 38 by the rotary wheel 132 whose peripheral teeth is partly exposed upwardly toward the lower surface of the separator plate 38. The free end portion of the lower arm 42 has a structure similar to that of the free end portion of the upper arm 40 so as to enable the rotary wheel 132 to be rotated by the servo motor 170. The servo motor 170 cooperates with the foregoing servo motor 142 to constitute first drive means for driving the rotary wheels 132 and 130 in order to move the work fabrics in the direction across the work feeding direction.

Similarly to the upper arm 40, the lower arm 42 is pivotally supported in the housing 14 by a pin 178 so that the rotary wheel 132 presses the lower work fabric against the lower surface of the separator plate 38.

To the intermediate wall 24, are attached the previously indicated stepping motors 134 and 138 whose output shafts are provided with pivot arms 180 and 182, respectively. The pivot arm 180 is connected at its end to the resilient link 136 to pivot the upper arm 40 about the pin 141 in the same direction as the direction of rotation of the stepping motor 134. The pivot arm 182 is connected to the resilient link 140 to pivot the lower arm 42 about the pin 178 in the direction opposite to the direction of rotation of the stepping motor 138. The original zero positions of these pivot arms 180 and 182 are detected by limit switches 184 and 186, respectively which are mounted on the intermediate wall 24. More specifically stated, the limit switch 184 is so positioned that it is energized by the pivot arm 180 when the free end of the upper arm 40 is lifted to its uppermost position, while the limit switch 186 is so position that it is energized by the pivot arm 182 when the free end of the lower arm 42 is lowered to its lowermost position.

The resilient link 136 comprises a cylinder 190 which has a bottomed end pivotally connected to the pivot arm 180 and accommodates therein a compression spring 188 serving as a resilient member, a rod 194 which is pivotally connected at one end thereof to the upper arm 40 and provided at the other end with a flange 192 bearing the adjacent end of the compression spring 188, and a thick-walled cylindrical slide metal 196 which is fixed to the open end portion of the cylinder 190 and supports the rod 194 axially slidably therethrough. Thus, the compression spring 188 is operatively connected to the upper arm 40 having the rotary wheel 130 and to the pivot arm 180, so that a pivotal movement of the pivot arm 180 in the counterclockwise direction as seen in FIG. 1 subsequent to engagement or contact of the rotary wheel 130 with the work fabric will cause the rod 194 to be moved further into the cylinder 190 thereby compressing the compression spring 188 between the flange 192 and the cylinder 190, whereby a contact pressure with which the work fabric is pressed by the rotary wheel 130 is adjusted according to an amount of compression of the spring 188.

Similarly, the resilient link 140 comprises a cylinder 198 pivotally connected at its bottomed end to the pivot arm 182 and accommodating a compression spring 200, a rod 204 pivotally connected at one end thereof to the lower arm 42 and having at the other end a flange 206 bearing the adjacent end of the compression spring 200, and a slide metal 202 fixed to the cylinder 198 and slidably supporting the rod 204. Consequently, after the rotary wheel 132 has contacted the work fabric, a pivotal movement of the pivot arm 182 in the counterclockwise direction will cause the rod 198 to be moved outwardly of the cylinder 198 thereby compressing the compression spring 200 between the flange 206 and the slide metal 202, whereby a contact pressure of the rotary wheel 132 is adjusted according to an amount of compression of the spring 200. As described above, the resilient links 136 and 140 combined with the pivot arms 180 and 182 constitute a contact pressure adjusting mechanism, and the stepping motors 134 and 138 operatively connected to the adjusting mechanism constitute second drive means to operate the pressure adjusting mechanism. The pressure adjusting mechanism, the second drive means and a later described control circuit cooperate to form pressure exerting means for the rotary wheels.

A photoelectric unit 208 is provided on the upper plate 36 to detect the trailing edge of the upper work fabric, and a photoelectric unit 209 is disposed in the cavity 116 to detect the trailing edge of the lower work fabric.

Reference numeral 210 designates screws which secure a support block 78 to the upper sliding plate 46. By loosening the screws 210 and pulling the support block 78 to the left as seen FIG. 2, the previously indicated clearance adjusting unit 76, upper plate 36, separator plate 38, photoelectric units 72 and 208, and other parts can be easily removed integrally with the support block 78. This arrangement allows an easy mounting of a pin tuck or other sewing attachment (not shown) on the support block 78 and thus provides for ready adaptation to a sewing operation with such attachment. The power supply to the photoelectric units 72 and 208 and the transmission of electric signals from those units are conducted via a connector (not shown) suitably located near the screws 210 in the housing 14.

On an operation control panel (not shown) located near the machine arm 10, there are provided: a pushbutton switch SW1 to turn on and off the sewing machine; a pushbutton switch SW2 to command automatic calculation of optimum contact pressures of the rotary wheels 130 and 132 to be applied to the work fabrics; a selector switch SW3 to select a single-layer sewing or a double-layer sewing; and a light emitting diode (LED) display 212 which flickers during calculation of the above optimum contact pressure and is kept illuminated after completion of the calculation to indicate the operational state of a control circuit described later.

Figure 4:
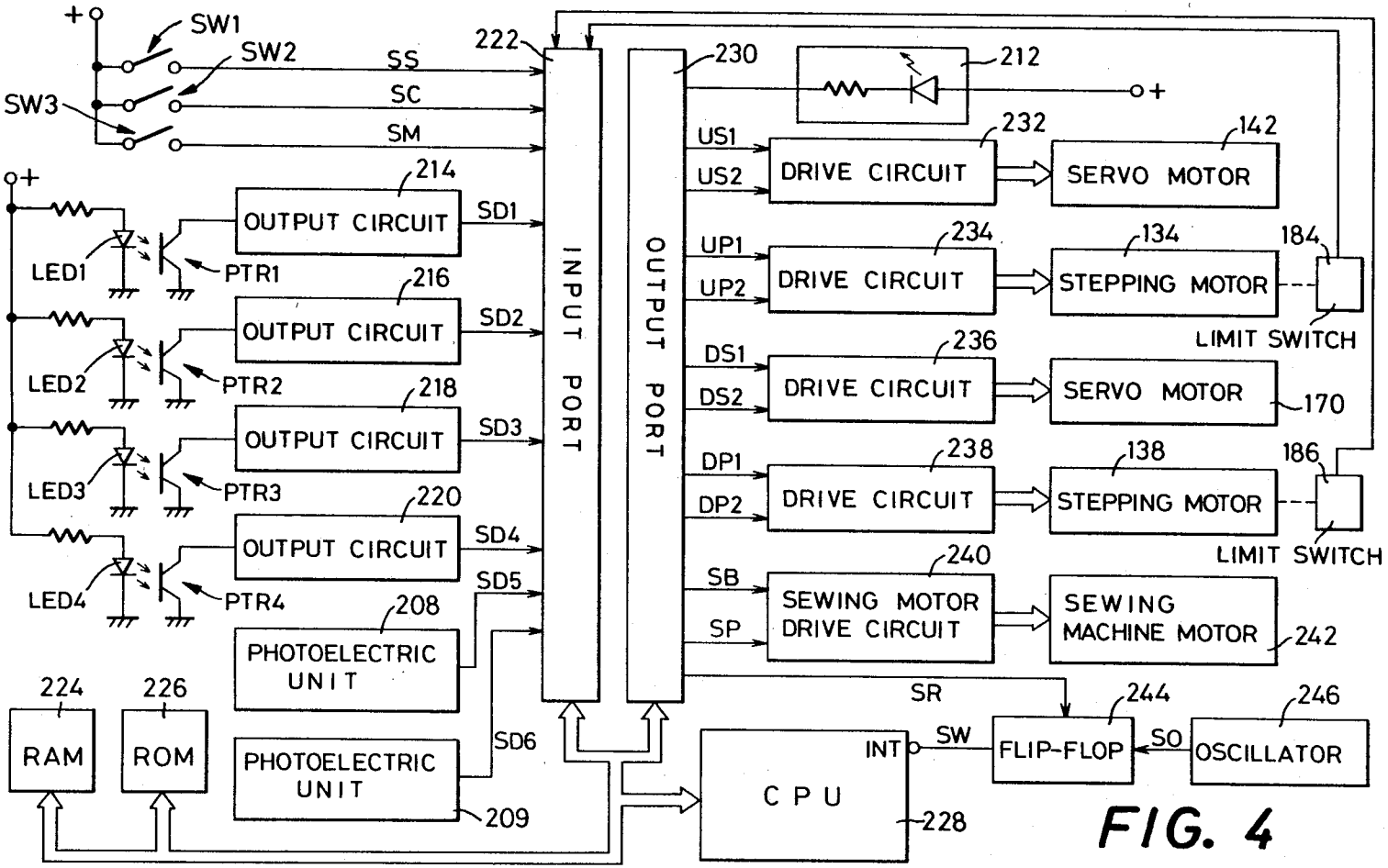
FIG. 4 is a block schematic diagram representing an electrical arrangement of the embodiment of FIG. 1.

The automatic work guiding apparatus constructed as described above is provided with a control circuit shown in FIG. 4.

In the figure, the light emitting diodes LED1, LED2, LED3 and LED4 are each connected between a positive power line and an earth line. Those diodes are adapted to always emit light toward the separator plate 36. The phototransistors PTR1, PTR2, PTR3 and PTR4 positioned in close proximity with the diodes are connected to output circuits 214, 216, 218, 220, respectively, which generate corresponding DETECTION signals SD1, SD2, SD3 and SD4 whose levels are high "H" (logical "1") when no light is received by the appropriate phototransistor PTR1, PTR2, PTR3 or PTR4 with a work fabric being present between the phototransistor and the separator plate 36, and low "L" (logical "0") when light is received by the phototransistor with no work fabric therebetween. Those DETECTION signals representative of presence or absence of the work fabric are fed to an input port 222. The input port 222 also receives: START-STOP signal SS from the pushbutton switch SW1; CONTACT PRESSURE CALCULATION signal SC from the pushbutton switch SW2; SINGLE-DOUBLE SEW signal SM from the selector switch SW3; and DETECTION signals SD5 and SD6 from the photoelectric units 208 and 209 which detect the trailing edge of the upper and lower work fabrics, respectively.

The signals received by the input port 222 are transmitted through a data bus line to a RAM (random access memory) 224, a ROM (read only memory) 226, a CPU (central processing unit) 228 designed as control means for the pressure exerting means and an output port 230. The CPU 228 is designed to execute steps of operation shown in FIGS. 7–11, provide output signals through the output port 230 and receive input signals through the input port 22, according to a program stored in the ROM 226 and by making use of a data storage function of the RAM 224. The RAM 224 includes: OPTIMUM CONTACT PRESSURE registers REG20 and REG30 storing data representative of the calculated contact pressures of the rotary wheels 130 and 132; CURRENT CONTACT PRESSURE registers REG21 and REG31 storing data representative of the currently established contact pressure of the wheels 130 and 132 (current angle of rotation of the stepping motors 134 and 138); DETECTION SIGNAL register REG40 storing signals representative of the current state of each photoelectric unit; TIMER register REG50; MOTOR CONTROL register REG60 storing signals to control the individual motors; and B-register REGB storing at its first bit (B0) and second bit (B1) signals representative of non-inhibit and inhibit conditions of the servo motors 142 and 170, respectively (logical "1" indicating non-inhibit condition and logical "0" indicating inhibit condition). The DETECTION SIGNAL and MOTOR CONTROL registers REG40 and REG60 each have a total of eight bits which store the signals as indicated in FIGS. 5 and 6, respectively.

An UPPER SERVO DIRECTION signal US1 represents a forward rotation of the servo motor 142 when its logical value is "1", and represents a reverse rotation thereof when the value is "0". An UPPER SERVO DRIVE signal US2 represents a stop of the servo motor 142 when its logical value is "1", and represents a start when the value is "0". An UPPER STEP MOTOR FORWARD signal UP1 drives the stepping motor 134 to operate in a direction that causes the contact pressure to be increased, and an UPPER STEP MOTOR REVERSE signal UP2 drives the stepping motor 134 to operate in a direction that causes the contact pressure to be decreased. Similarly, a LOWER SERVO DIRECTION signal DS1 represents a forward rotation of the servo motor 170 when its logical value is "1", and represents a reverse rotation thereof when the value is "0". A LOWER SERVO DRIVE signal DS2 represents a stop of the servo motor 170 when its logical value is "1", and represents a start when the value is "0". A LOWER STEP MOTOR FORWARD signal DP1 drives the stepping motor 138 to operate in a direction that causes the contact pressure to be increased, and a LOWER STEP MOTOR REVERSE signal DP2 drives the stepping motor 138 in a direction that causes the contact pressure to be decreased. Under command of the CPU 228, the UPPER SERVO DIRECTION signal US1 and the UPPER SERVO DRIVE signal US2 are supplied from the output port 230 to a drive circuit 232 which in turn supplies corresponding drive power to the upper servo motor 142 so as to operate it in the direction selected by the signal US1 and for a time interval specified by the signal US2. In the meantime, the UPPER STEP MOTOR FORWARD signal UP1 and the UPPER STEP MOTOR REVERSE signal UP2 are selectively supplied to a drive circuit 234 which supplies corresponding drive power (drive pulses) to the upper stepping motor 134 so as to operate it the specified angle in the specified direction. Similarly, the LOWER SERVO DIRECTION and DRIVE signals DS1 and DS2 are fed from the output port 230 to a drive circuit 236 while the LOWER STEP MOTOR FORWARD and REVERSE signals DP1 and DP2 are selectively supplied to a drive circuit 238, so that the drive circuits 236 and 238 provide the respective lower servo and stepping motors 170 and 138 with corresponding drive power. In addition, START and STOP signals SB and SP to start and stop a sewing machine motor 242 are selectively supplied from the output port 230 to a drive circuit 240 which controls power supply to the motor 242 so as to start and stop it according to the signals SB and SP.

A flip-flop circuit 244 which presents an INTERRUPTION signal SW to the CPU 228, is adapted to be placed in its set state by a SET signal SO (1 KHz) from an oscillator 246 and changed into its reset state by a RESET signal SR from the output port 230. The limit switches 184 and 186 are connected to the input port 222, so that the original zero positions of the stepping motors 134 and 138 are detected by signals from those limit switches, i.e., the signals are generated from the switches 184 and 186 when the free ends of the upper and lower arms 40 and 42 are located at their uppermost and lowermost positions remote from the upper and lower work fabrics, respectively. The LED display 212 is connected to the output port 230 so that it is operated according to signals from the output port.

There will be described the operation of the work guiding apparatus constructed as described above.

Upon turning on a power source switch (not shown) and consequent application of power to the control circuit shown in FIG. 4, a main program illustrated in a flow chart of FIG. 7 is executed. Put in more detail, steps MS1 and MS2 are first performed to execute an initializing routine wherein all registers within the CPU 228 and RAM 224 are cleared, and to check if the pushbutton switch SW2 is in the ON or OFF position. When the switch SW2 is in the ON position, a CONTACT PRESSURE CALCULATION routine is executed in the next step MS3 and then step MS4 will follow. When the switch SW2 is in the OFF position, the step MS3 is omitted, i.e., the control goes directly to the step MS4. In other words, the step MS3 is performed prior to a sewing cycle when the pushbutton switch SW2 has been turned on by the operator immediately after power application to the machine for the purpose of re-establishing optimum contact pressures of the rotary wheels 130 and 132 for a new batch of work fabrics to be sewn. In the step MS4, the pushbutton switch SW1 is checked to see if it is in the ON or OFF position. When the switch SW1 is OFF, the control goes back to the step MS2 and repeats execution of the steps MS2-MS4. When the switch SW1 is ON, the control goes to a step MS5 to execute a sewing routine and returns to the step MS2 at the end of the sewing operation. More specifically, when the pushbutton switch SW1 is turned on, the rotary wheels 130 and 132 are brought into contact with the respective work fabrics with the contact pressure determined in the step MS3, and the workfabrics are sewn while they are guided by those wheels 130 and 132 with their side edges being positioned with respect to the reference position.

The following description refers to the operations to be performed according to the CONTACT PRESSURE CALCULATION routine and the SEWING routine:

CONTACT PRESSURE CALCULATION Routine

Figure 8:
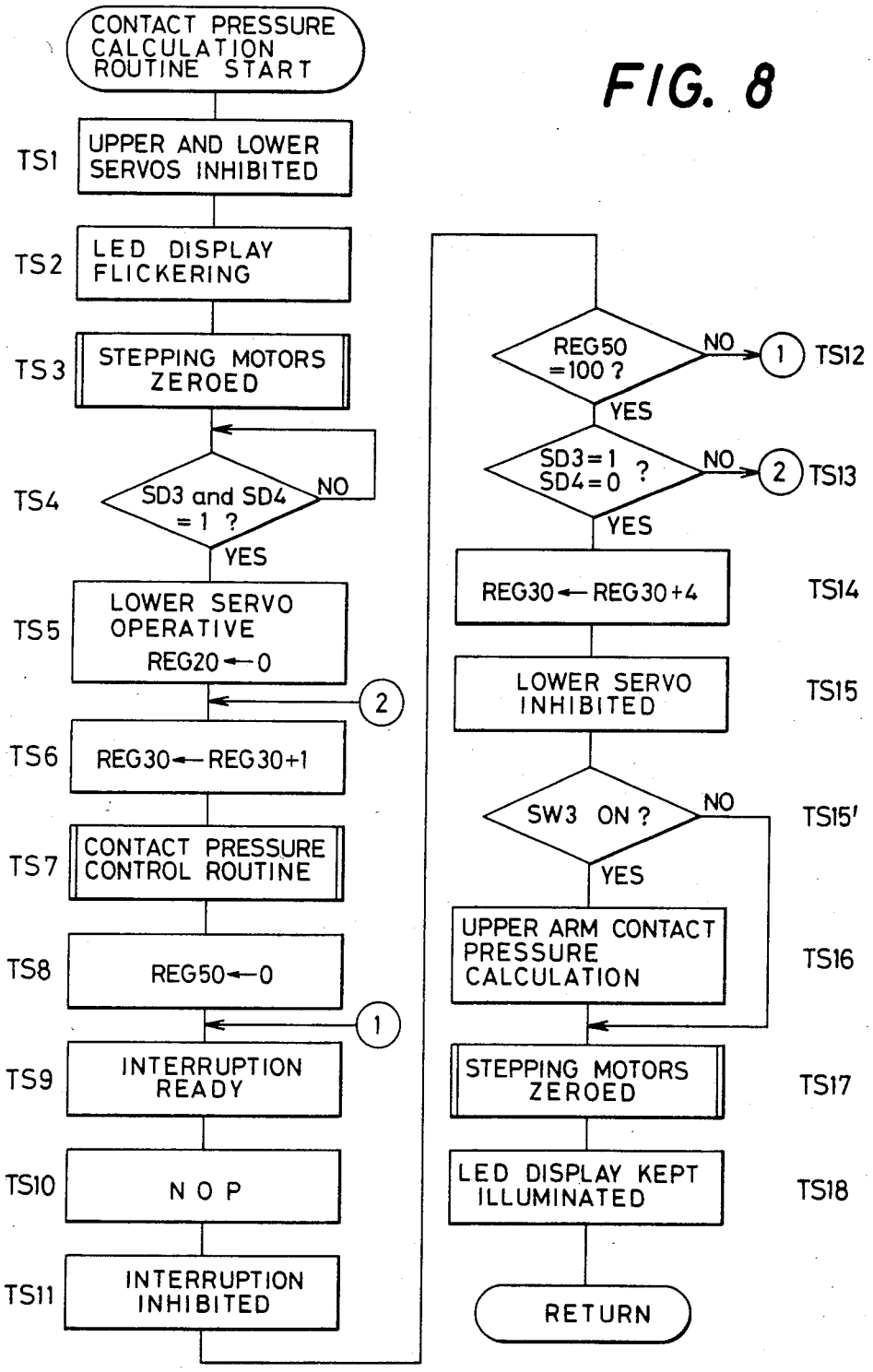
FIGS. 8 through 11 are flow charts showing a contact pressure calculation routine, a contact pressure control routine, an interruption routine and a sewing routine, respectively, inserted in the main program of FIG. 7.

The CONTACT PRESSURE CALCULATION routine is executed as shown in a flow chart of FIG. 8. At first, steps TS1 through TS4 are performed as follows: In the step TS1, a logical "0" is set at the first bit (B0) and the second bit (B1) of the B-register REGB to inhibit the operation of the upper and lower servo motors 142 and 170. In the step TS2, a current is supplied interruptedly to the LED display 212 to cause it to flicker. In the step TS3, appropriate drive signals are fed to the stepping motors 134 and 138 until the limit switches 184 and 186 are energized whereby their output shafts are oriented at their zero positions, that is, the free ends of the upper and lower arms 40 and 42 are located at their uppermost and lowermost positions remote from the separator plate 38. The step TS4 is performed to check to see if the DETECTION signals SD3 and SD4 are "1" or not, viz., if the work fabric to be sewn has been properly inserted by the operator between the separator plate 38 and the spacer plate 16 until its side edge has reached the predetermined position where it blocks paths of lights which are to be received by the phototransistors PTR3 and PTR4.

When at least one of the DETECTION signals SD1 and SD2 is "1" because the work fabric has not been inserted or has been inserted incompletely, the step TS4 is repeated until the work fabric has been completely and correctly oriented. Upon completion of the orientation of the work fabric, the next step TS5 and the subsequent steps are sequentially conducted.

In the step TS5, a logical "1" is set at the first bit (B0) of the B-register and the lower servo motor 170 is allowed to operate. In the step TS6, a value "1" is added to the content of the OPTIMUM CONTACT PRESSURE register REG30 for the rotary wheel 132 on the lower arm 42. In the step TS7, a CONTACT PRESSURE CONTROL routine is executed, that is, the stepping motor 138 is operated to the position represented by the content of the CONTACT PRESSURE register REG30.

Figure 9:
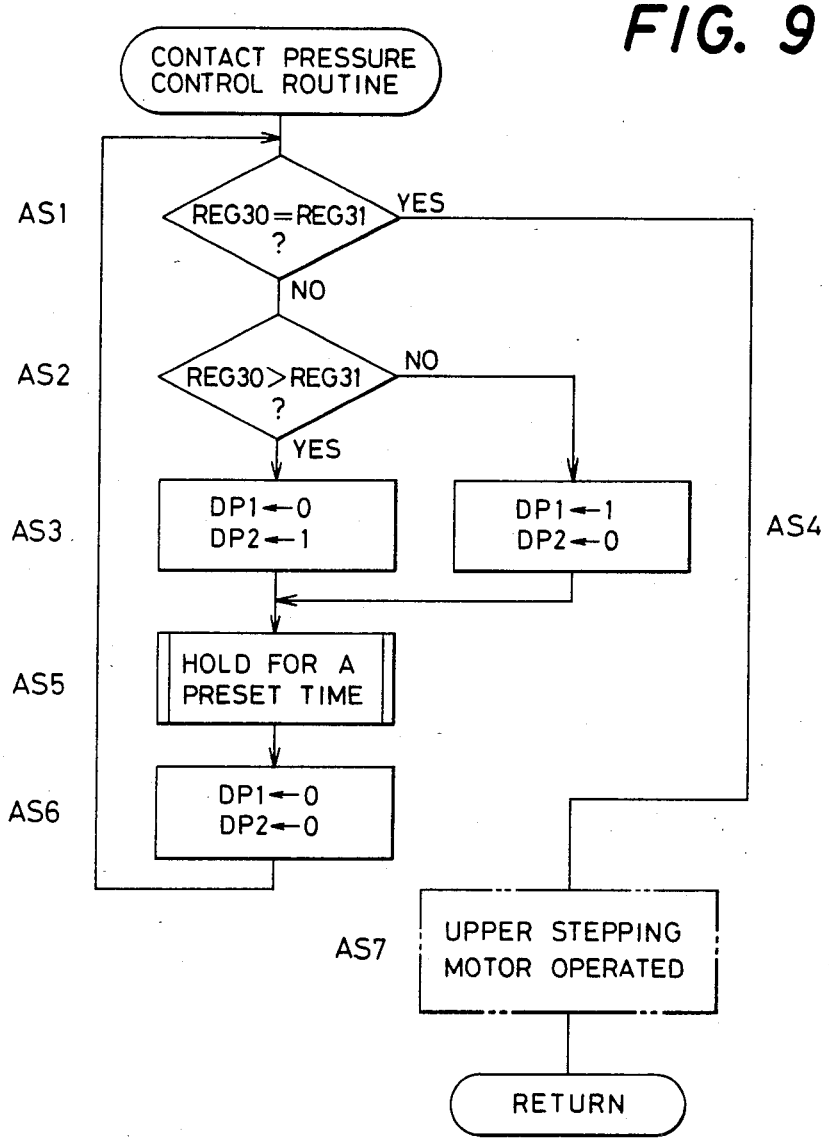

The CONTACT PRESSURE routine is executed as shown in a flow chart of FIG. 9. Initially, a step AS1 is performed to check if the content of the OPTIMUM CONTACT PRESSURE register REG30 is coincident with that of the CURRENT CONTACT PRESSURE register REG31. When they are coincident, the control jumps to a step AS7. When they are not coincident, the control proceeds to a step AS2 to check if the content of the OPTIMUM CONTACT PRESSURE register REG30 is greater than that of the CURRENT CONTACT PRESSURE register REG31. The control then goes to a step AS3 if the former is greater, but jumps to a step AS4 if the former is smaller.

In the step AS3, a logical "0" is set in the 7th bit (B6) of the MOTOR CONTROL register REG60 and a logical "1" in the 8th bit (B7) of the same. Conversely, in the step AS4, a logical "1" is set in the 7th bit and a logical "0" in the 8th bit. In the next step AS5, the contents of the 7th and 8th bits of the register REG60 which have been changed in the previous step AS3 or AS4 are held for a preset length of time. After the preset length of time, the contents of the 7th and 8th bits are both zeroed in the following step AS6.

Since the contents of the MOTOR CONTROL register REG60 represent signals to be supplied to the respective motors, the execution of a series of the above steps AS2 through AS6 will produce one pulse of LOWER STEP MOTOR FORWARD signal DP1 or LOWER STEP MOTOR REVERSE signal DP2 which is supplied to the drive circuit 238, and will cause the content of the CURRENT CONTACT PRESSURE register REG31 to be increased by "1". As a result, the drive circuit 238 provides one pulse of drive power to the lower stepping motor 138 to operate it the specified increment angle. The width of the pulse which is identical to the holding time in the step AS5, is determined by the specific frequency response of the stepping motor 138. The above one-pulse stepping of the motor 138 will be repeated until the contents of the OPTIMUM and CURRENT CONTACT PRESSURE registers REG30 and REG31 become coincident in every execution of step AS1 to AS6. However, the content of the OPTIMUM CONTACT PRESSURE register REG30 was increased by only "1" in the foregoing OPTIMUM CONTACT PRESSURE CALCULATION routine in the step TS6, the rotary wheel 132 at the end of the lower arm 42 is moved toward the work fabric by an amount corresponding to the one-pulse increment angle of rotation of the stepping motor 138.

In the next step AS7, the contents of the 3rd bit (B2) and the 4th bit (B3) of the register REG60 are so set as to operate the upper stepping motor 134 until a difference between the contents of the OPTIMUM and CURRENT CONTACT PRESSURE registers REG20 and REG21 has become zero, i.e., they have coincided with each other. To this end, the step AS7 includes steps similar to the above discussed steps AS1 through AS6 for operating the lower stepping motor 138. In the step AS7 of the CONTACT PRESSURE CONTROL routine in the step TS7 of the OPTIMUM CONTACT PRESSURE CALCULATION routine shown in FIG. 8, the upper stepping motor 134 is not operated in this step AS7 because the OPTIMUM CONTACT PRESSURE register REG20 has been cleared in the step MS1 of the main program shown in FIG. 7 and its content is coincident to that of the CURRENT CONTACT PRESSURE register REG21.

Referring back to FIG. 8, the step TS7 wherein a series of operations of the CONTACT PRESSURE CONTROL routine are performed is followed by a step TS8 wherein a TIMER register REG50 is cleared, a step TS9 wherein the control is allowed to execute an INTERRUPTION routine, and a step TS10 wherein a predetermined length of non-operation time is provided for allowing execution of the INTERRUPTION routine to operate the servo motor 170.

Figure 10:
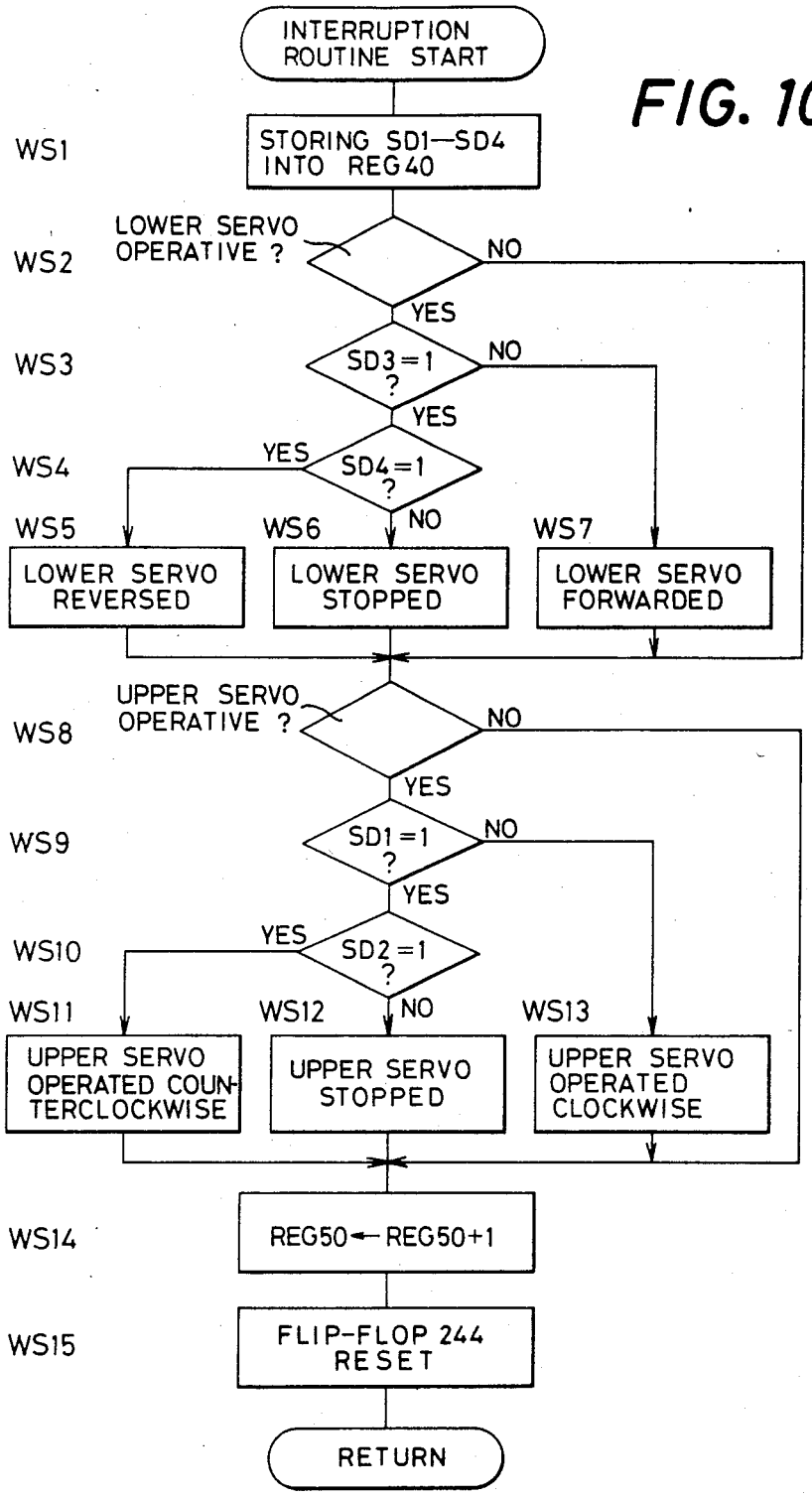

The INTERRUPTION routine is executed as shown in a flow chart of FIG. 10. In the first step WS1, the current DETECTION signals SD1 through SD4 are temporarily stored in a DETECTION SIGNAL register REG40. Then, a step WS2 is performed to check if the content of the 2nd bit of the B-register REGB is "1" or not, i.e., if the operation of the lower servo motor 170 is allowed or not. When its operation is not allowed, that is, when the motor 170 is in the inhibited state, the control goes to a step WS8. When the its operation is allowed, steps WS3 and subsequent are performed sequentially. In the step WS3, the control checks if the DETECTION signal SD3 is "1" or not, i.e., if the side edge of the work fabric is located right above the phototransistor PTR3 which is positioned on the inner side of the work fabric. When the side edge is not located right above the phototransistor PTR3, the control proceeds to a step WS7 wherein a logical "1" is set at the 5th bit (B4) of the MOTOR CONTROL register REG60, and a logical "0" is set at the 6th bit (B5) of the same, whereby the LOWER SERVO DIRECTION signal indicative of a forward rotation of the servo motor 170 and the LOWER SERVO DRIVE signal DS2 indicative of a start of the motor 170 are supplied to the drive circuit 236 which in turn directs the lower servo motor 170 to operate so as to rotate the rotary wheel 132 in the direction (clockwise as seen in FIG. 1) that causes the work fabric to be moved to the right as seen in FIGS. 1 and 2.

When the DETECTION signal SD3 is "1", a step WS4 is performed to check if the DETECTION signal SD4 is "1", i.e., if the side edge of the work fabric is located right above the phototransistor PTR4 which is positioned on the outer side of the work fabric. When the side edge is located right above the phototransistor PTR4, the control goes to a step WS5 wherein a logical "0" is set at both 5th and 6th bits of the register REG60, whereby the servo motor 170 is operated in the direction (counterclockwise as seen in FIG. 1) that causes the work fabric to be moved to the left as seen in FIGS. 1 and 2, contrary to the rightward movement in the step WS7. When the side edge of the work fabric is located at the predetermined reference position between the phototransistors PTR3 and PTR4, only the DETECTION signal SD4 is "0" and this causes the control to proceed to a step WS6 wherein the content of the 5th bit of the MOTOR CONTROL register REG60 is held to be "1" and consequently the servo motor 170 is kept at rest. In summary, the rotary wheel 132 is operated according to the DETECTION signals SD3 and SD4 so that the side edge of the lower work fabric is located at the predetermined reference position.

After one of the steps WS5, WS6 and WS7 has been completed, steps WS8 through WS13 which are similar to the above steps WS1 through WS7 will be performed to control the operation of the upper rotary wheel 130 according to the DETECTION signals SD1 and SD2 so that the side edge of the upper work fabric is located at the predetermined reference position between the phototransistors PTR1 and PTR2. In the INTERRUPTION routine in the step TS10 of the CONTACT PRESSURE CALCULATION routine, however, the upper servo motor 142 has not yet been allowed to operate and therefore the step WS8 is immediately followed by a step WS14.

In the step WS14, a value "1" is added to the content of the TIMER register REG50. In the next step WS15, a RESET signal SR is generated from the output port 230 to reset the flip-flop 244.

At the end of a series of operations of the above INTERRUPTION routine, the control goes to a step TS11 of the CONTACT PRESSURE CALCULATION routine.

Referring back to FIG. 8 again, an interruption routine is inhibited in the step TS11 which is followed by a step WS12 to check if the content of the TIMER register REG50 is "100" or not. When the content of the register REG50 has not become equal to or greater than "100", the steps TS9 and subsequent are executed again. More specifically stated, the flip-flop 244 is placed in the set state every one millisecond in response to the SET signals SO from the oscillator 246 and the steps TS9 through TS12 are therefore repeated 100 times at a time interval of approximately one millisecond until the content of the register REG50 has become equal to "100". During the time interval (approximately 0.1 second) of this repetition of the above steps, the servo motor 170 is operated.

When the content of the TIMER register REG50 has become "100", a step TS13 is performed to check if the content of the DETECTION signal SD3 is "1" and the content of the DETECTION signal SD4 is "0", i.e., if the side edge of the lower work fabric is located at the predetermined reference position or not. In the event the side edge is not located at the reference position, the steps TS6 and subsequent are again executed. In other words, if the side edge of the lower work fabric has not been located at the reference position even after the rotation of the rotary wheel 132 in the steps TS9 through TS12, the steps TS6, TS7 and TS8 are executed one more time in order to rotate the output shaft of the stepping motor 138 the specified increment angle so that the pressure of contact of the rotary wheel 132 with the work fabric between the separator plate 38 and the spacer plate 16 is increased to a higher level.

The above steps TS6 through TS13 are repeated until a pressure of contact of the rotary wheel 132 has been gradually increased with elastic compression of the coil spring 200 and the side edge of the work fabric has been properly located at the reference position by means of the rotation of the rotary wheel 132 which has the thus increased contact pressure. Then, the control proceeds to a step TS14 wherein an extra value of "4" ia added to the content of the OPTIMUM CONTACT PRESSURE register REG30 to increase the contact pressure to a higher level for assuring stable work guiding performance of the wheel 132. The content of the OPTIMUM CONTACT PRESSURE register REG30 at this time corresponds to an optimum contact pressure of the wheel 132 applied to the lower work fabric. This optimum contact pressure is established through a resilient force of the compression spring 200 when the output shaft of the stepping motor 138 is rotated until the content of the register REG30 has coincided with that of the CURRENT CONTACT PRESSURE register REG31.

Successively, the control goes to a step TS15 wherein a logical "0" is set at the 2nd bit of the B-register REGB and the operation of the lower servo motor 170 is inhibited. This completes the operation to establish an optimum pressure of contact of the lower rotary wheel 132 with the lower work fabric. Thus, the steps TS1 through TS15 are for setting up an optimum pressure of the lower arm 42.

In the next step TS15', the control checks if the selector switch SW3 is set in the SINGLE-LAYER SEW position or in the DOUBLE-LAYER SEW position. When the switch SW3 is in the SINGLE-LAYER SEW position, the control goes to a step TS17 described later. When the switch SW3 is in the DOUBLE-LAYER SEW position, the control executes a step TS16 which includes steps similar to the previously discussed steps TS4 through TS15 in order to establish an optimum pressure of contact of the rotary wheel 130 with the upper work fabric. This step TS16 is different from the combination of the above steps TS4–TS15 in that the DETECTION signals SD3 and SD4 in the steps TS4 and TS13 are replaced by DETECTION signals SD1 and SD2, that the lower servo motor 170 in the steps TS5 and TS15 are replaced by the upper servo motor 142, and that the OPTIMUM CONTACT PRESSURE register REG30 in the steps TS5, TS6 and TS14 are replaced by the OPTIMUM CONTACT PRESSURE register REG20. Thus, the step TS16 is for setting up an optimum pressure of the upper arm 40.

More particularly stated, the upper rotary wheel 130 is controlled such that the side edge of the upper work fabric is located at the reference position between the phototransistors PTR1 and PTR2 and that the contact pressure of the wheel 30 is gradually increased to an elevated pressure. After the side edge of the work fabric has been located at its reference position by the wheel 130 with the optimum contact pressure, an extra value "4" is added to the content of the OPTIMUM CONTACT PRESSURE register REG20. Thus, the optimum pressure of contact of the upper rotary wheel 130 with the upper work fabric is automatically established.

Successively, the control proceeds to a step TS17 similar to the step TS3, wherein the stepping motors 134 and 138 are operated until their output shafts are rotated to their zero positions at which the corresponding limit switches 184 and 186 are energized, whereby the free ends of the upper and lower arms 40 and 42 are moved away from the separator plate 38. Then, a step TS18 is performed to cause the LED display 212 to indicate that the OPTIMUM CONTACT PRESSURE CALCULATION routine has been completed. In other words, the LED display 212 which has been flickering to indicate that the above routine is under execution, stops flickering and is kept illuminated to indicate the completion of the routine. This indication by the display 212 provides convenient means for visual inspection or judgement of whether the optimum contact pressure has been established or not before the pushbutton switch SW1 is depressed to initiate a sewing cycle.

SEWING Routine

Figure 11:
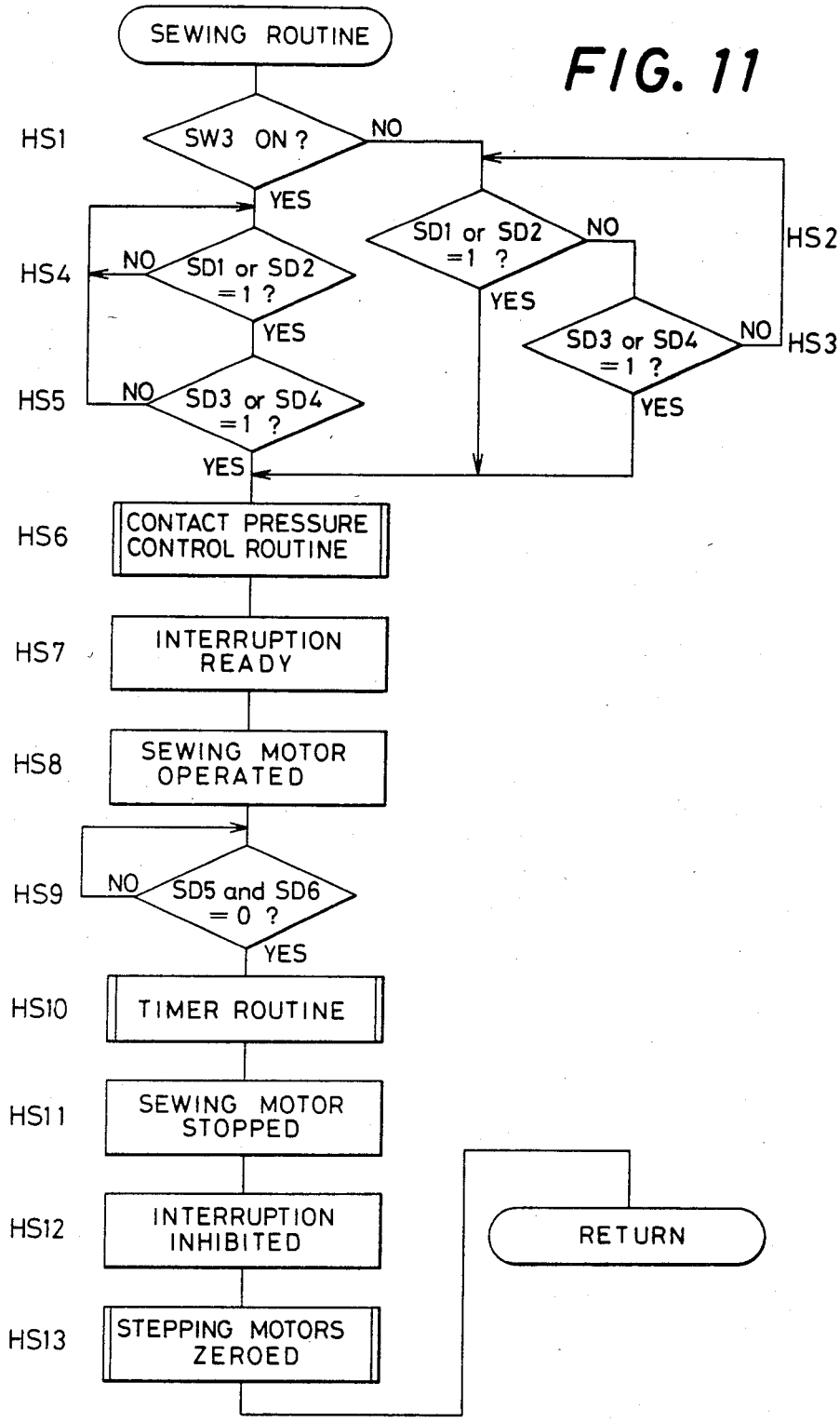

The SEWING routine is executed as shown in a flow chart of FIG. 11. In the first step HS1, the control checks if the selector switch SW3 is set in the SINGLE- and DOUBLE-WORK SEW position. When the switch SW3 is open and generates a SINGLE-DOUBLE SEW signal representative of a sewing of two work fabrics, a step HS2 is performed to check if either one of the DETECTION signals SD1 and SD2 is "1", i.e., if a work fabric has been inserted between the separator plate 38 and the upper plate 36. When no work fabric is present therebetween, a step HS3 is performed to check if either one of the DETECTION signals SD3 and SD4 is "1", i.e., if a work fabric has been inserted between the separator plate 38 and the spacer plate 16. When no work fabric is present therebetween, the step HS2 is again performed. When it is found in the step HS2 or HS3 that a work fabric is present, the control starts a sewing operation according to steps HS6 and subsequent. When it is found in the step HS1 that the selector switch SW3 is placed in the DOUBLE-WORK SEW position, steps HS4 and HS5 are executed to check if upper and lower work fabrics have been inserted between the separator plate 38 and the upper plate 36, and between the separator plate 38 and the spacer plate 16, respectively. The control goes to the step HS6 only when it is found that both upper and lower work fabrics are present at the respective positions.

In the step HS6, the CONTACT PRESSURE CONTROL routine shown in FIG. 9 is executed so that the stepping motors 134 and 138 are operated according to the data stored in the OPTIMUM CONTACT PRESSURE registers REG20 and REG30 whereby the upper and lower rotary wheels 130 and 132 are brought into contact with the upper and lower work fabrics with the optimum contact pressure. Successively, a step HS7 is performed to permit execution of the INTERRUPTION routine. In the subsequent steps up to HS12, therefore, priority is given to the INTERRUPTION routine which is repeated every about one millisecond to accomplish a cyclic control of guiding the work fabrics so that the side edges are located at the predetermined reference positions.

In the next step HS8, the START signal SB is fed from the output port 230 to the sewing motor drive circuit 40 to turn on the sewing motor 242. Therefore, a sewing cycle is conducted to form successive stitches along a line inwardly spaced a fixed distance from the side edges of the work fabrics while the side edges are guided so as to be located, at the reference positions.

Then, the control goes to a step HS9 to check if both DETECTION signals SD5 and SD6 representing the trailing edges of the work fabrics are "0". When both signals SD5 and SD6 are "0", a step HS11 is performed after a lapse of time in a TIMER routine of step HS10. In the step HS11, the STOP signal is fed from the output routine 230 to the drive circuit 240 which in turn supplies a current to immediately stop the sewing motor 242. It is noted that the time delay in the step HS10 is provided to assure that stitches are formed to the trailing edges of the work fabrics under cooperation of the feed dog 35 and the needle 34 after the trailing edges have been detected by the photoelectric units 208 and 209.

Following the step HS11, a step HS12 is performed to inhibit the execution of the INTERRUPTION routine. The stepping motors 134 and 138 are zeroed in the next step HS13, whereby the free ends of the upper and lower arms 40 and 42 are moved away from the separator plate 38 to facilitate removal of the sewn work fabrics and placement of new work fabrics.

As described above, the present embodiment of an automatic work guiding apparatus constructed according to the invention is capable of controlling the rotary wheels 130 and 132, and the upper and lower arms 40 and 42, according to the CONTACT PRESSURE CALCULATION routine so that the side edges of the work fabrics are located at the predetermined position and that the pressure of contact of the wheels is gradually increased to a level that permits the work fabrics to be correctly positioned with the side edges at the reference position. The contact pressure is further increased by an extra amount to establish an optimum level. This automatic setting of the optimum contact pressure of the rotary wheels against the work fabrics will eliminate the need for trial sewing operations to set up an optimum level of the contact pressure that suits specific kinds of work fabrics of different materials, thickness, etc., thereby saving non-productive time for such trial sewing operations and ensuring efficient production of high-quality products without requiring a high standard of operator's skill.

While the present invention has been described in its preferred form particularly illustrated in the accompanying drawings, it is to be understood that the invention is not limited thereto but may be otherwise embodied.

As an example, the work guiding apparatus may be equipped only with the upper arm 42 as the sewing machine is designed for a single-work sewing application. In this instance, the following steps may be omitted: TS4 through TS15 of the CONTACT PRESSURE CALCULATION routine in FIG. 8; AS1 through AS6 of the CONTACT PRESSURE CONTROL routine in FIG. 9; WS2 through WS7 of the INTERRUPTION routine in FIG. 10; and HS1 through HS3 and HS5 of the SEWING routine in FIG. 11.

The value to be added to the content of the OPTIMUM CONTACT PRESSURE register REG30 in the step TS6 of the CONTACT PRESSURE CALCULATION routine may be "2" or greater as required, or it may be a negative value such as "−1" and "−2". In the case where a negative value is added, the pressure of contact of the rotary wheels 130 and 132 with the work fabrics is increased to an elevated level before the step TS6 has been performed and an optimum contact pressure of those wheels is established while their pressure is gradually decreased.

Similarly, the value "100" with which the content of the TIMER register REG50 is compared in the step TS12 of the CONTACT PRESSURE CALCULATION routine may be changed as required. Further, the extra value "4" to be added to the content of the OPTIMUM CONTACT PRESSURE register REG30 in the step TS14 may be changed to other values including "0" as required. When an optimum contact pressure of the wheels 130 and 132 is established while their pressure is decreased as indicated above, such extra value may be negative.

While the rotary wheels are operated in the INTERRUPTION routine of the step TS10 after the contact pressure has been changed in the step TS7, these two steps of operations may be performed in the reversed order or simultaneously.

It is also possible that a so-called microcomputer or micro-processer comprising a single board or chip may constitute in part or whole the CPU 228, RAM 224, ROM 226, flip-flop 244 and oscillator 246.

While the described embodiment represents the preferred form of the present invention, it will be obvious to those skilled in the art that various modifications and alterations may be made without departing from the scope of the appended claims.

What is claimed is:

1. In a fabric-guiding apparatus for guiding a fabric layer in a direction intersecting a line of fabric feed in a sewing machine having a seam forming mechanism and a fabric feeding mechanism for sewing along a side edge of said fabric layer, including (a) a detector member disposed ahead of said seam forming mechanism in a direction of said line of fabric feed, including a detector element sensing said side edge of the fabric layer and generating a detection signal indicative of the sensing of said side edge, (b) a guiding wheel rotatable about an axis parallel to said line of fabric feed and engageable with the surface of said fabric layer, (c) pressure exerting means for exerting a contact pressure urging said guiding wheel into engagement with the surface of said fabric layer, and (d) first drive means, operative in response to said detection signal from said detector member, for rotating said guiding wheel selectively in forward and reverse directions for moving said side edge of the fabric layer on said detector element laterally with respect to said line of fabric feed, said pressure exerting means comprising:

a pressure adjusting mechanism to adjust said contact pressure;

second drive means to actuate said pressure adjusting mechanism;

a drive circuit connected to said second drive means and operative in response to command signals;

a memory for storing command data relating to said command signals and representative of said contact pressure; and control means for automatically establishing an optimum level of said contact pressure, said control means (a) supplying to said drive circuit a predetermined number of said command signals for changing said contact pressure in steps of a predetermined amount prior to a normal operation of the fabric-guiding apparatus during formation of a seam by said seam forming and fabric feed mechanism, (b) outputting a rotation signal to operate said first drive means for laterally moving said fabric layer when each of said predetermined number of command signals is supplied to said drive circuit, (c) checking according to said detection signal from said detector element whether or not said fabric layer has been moved into position by said guiding wheel, (d) updating said command data each time said predetermined number of command signals have been supplied to said drive circuit, and (e) stopping the updating of said command data when said detection signal indicates that said fabric layer has been moved into position, whereby said command data stored in said memory when said detection signal has been generated relates to said optimum level of of contact pressure.

2. A fabric-guiding apparatus according to claim 1, wherein said control means includes means for automatically applying said optimum level of contact pressure to said guiding wheel and the surface of said fabric layer during said normal operation of the fabric-guiding apparatus, which reads out said command data stored in said memory and supplies to said drive circuit said command signals corresponding to said command data read out from said memory to operate said second drive means.

3. A fabric-guiding apparatus according to claim 1, wherein said second drive means comprises a stepping motor and said control means comprises a microprocessor connected to said drive circuit and supplying pulse signals to said drive circuit.

4. A fabric-guiding apparatus according to claim 2, wherein said second drive means comprises a stepping motor and said control means comprises a microprocessor connected to said drive circuit and supplying pulse signals to said drive circuit.

5. A fabric-guiding apparatus according to claim 1, wherein said control means adds a predetermined extra value to the updated command data when said fabric layer has been moved into position, whereby the content of said memory represents said optimum level of contact pressure.

6. A fabric-guiding apparatus according to claim 1, wherein said pressure adjusting mechanism includes a resilient link connected at one end thereof to said guiding wheel, said second drive means comprising a stepping motor connected to the other end of said resilient link.

7. A fabric-guiding apparatus for a sewing machine having a table, a seam forming mechanism and a fabric feed mechanism for sewing two superposed layers of work fabric, comprising:

a detector member disposed ahead of said seam forming mechanism in a direction of work feed, and including a pair of detector elements sensing side edges of said two layers of work fabric, respectively and each generating a detection signal indicative of the sensing of the respective side edge;

a separator-plate disposed ahead of said seam forming mechanism in said work feed direction and separating said two layers so as to position the side edge of one of said two layers on said separator plate and that of the other below said separator plate;

a first guiding wheel rotatable about an axis parallel to a line of said work feed direction and engageable with the upper surface of the upper layer above said separator plate;

a second guiding wheel rotatable about another axis parallel to said line of the work feed direction and engageable with the lower surface of the lower layer below said separator plate;

a pair of drive motors operative in response to said detection signals to rotate said first and second guiding wheels independently of each other selectively in forward and reverse directions for positively positioning said side edges of the two layers on said detector elements respectively;

first pressure exerting means for exerting a first contact pressure urging said first guiding wheel into engagement with said upper surface of the upper layer, said first pressure exerting means having a first adjusting mechanism and a first electric motor operative in response to command signals to actuate said first adjusting mechanism for adjusting said first contact pressure;

second pressure exerting means for exerting a second contact pressure urging said second guiding wheel into engagement with said lower surface of the lower layer, said second pressure exerting means having a second adjusting mechanism and a second electric motor operative in response to command signals to actuate said second adjusting mechanism for adjusting said second contact pressure;

a memory for storing command data relating to said command signals and representative of said first and second contact pressures;

a pair of drive circuits operating said pair of drive motors according to said command signals, respectively, until optimum levels of said first and second contact pressures have been established; and control means for automatically establishing the optimum levels of said first and second contact pressures, said control means (a) supplying to said pair of drive circuits predetermined numbers of said command signals for changing said first and second contact pressures in steps of a predetermined amount prior to a normal operation of the fabric-guiding apparatus, (b) outputting rotation signals to operate said pair of drive motors for laterally moving said two superposed layers when said predetermined numbers of command signals are supplied to said said pair of drive circuits, (c) checking according to said detection signals from said detector elements whether or not said two layers have been moved into position by said first and second guiding wheels, (d) updating said command data each time said predetermined numbers of the command signals have been supplied to said pair of drive circuits, and (e) stopping the updating of said command data when said detection signals indicate that said two layers have been moved into position, whereby said command data stored in said memory when said detection signals have been generated represent said optimum levels of first and second contact pressures.

8. A fabric-guiding apparatus according to claim 7, wherein said first and second electric motors are stepping motors.

9. A fabric-guiding apparatus according to claim 7, wherein said first and second adjusting mechanisms each have a resilient link connected at one end thereof to said guiding wheel and at the other end thereof to said electric motor.

10. A fabric-guiding apparatus according to claim 8, wherein said first and second adjusting mechanisms each have a resilient link connected at one end thereof to said guiding wheel and at the other end thereof to said stepping motor.

* * * * *